United States Patent [19]

Adkins

[11] Patent Number: 4,881,875

[45] Date of Patent: Nov. 21, 1989

[54] BOUNDARY LAYER CONTROL IN SUPERSONIC NOZZLE

[75] Inventor: Richard C. Adkins, Milton Keynes, United Kingdom

[73] Assignee: British Aerospace PLC, London, England

[21] Appl. No.: 190,654

[22] Filed: May 5, 1988

[30] Foreign Application Priority Data

May 6, 1987 [GB] United Kingdom ..... 8710733

[51] Int. Cl.[4] ..... F04F 5/46

[52] U.S. Cl. ..... 417/54; 60/264; 60/269; 417/197; 417/163; 417/198

[58] Field of Search ..... 417/196, 151, 197, 193, 417/179, 180, 163, 171, 174, 194, 198, 166, 177, 54, 168; 60/39.49, 264, 269, 755

[56] References Cited

U.S. PATENT DOCUMENTS

| | | | |
|---|---|---|---|
| 3,371,618 | 3/1968 | Chambers | 417/196 |
| 3,525,474 | 8/1970 | Von Ohain et al. | 417/163 |
| 3,739,576 | 6/1973 | Chamberlain | 417/171 |
| 4,028,009 | 6/1977 | Gudzenko et al. | 417/179 |

FOREIGN PATENT DOCUMENTS

| | | | |
|---|---|---|---|
| 178873 | 4/1986 | European Pat. Off. . | |
| 196764 | 10/1986 | European Pat. Off. . | |
| 0441031 | 10/1948 | Italy | 417/197 |
| 436001 | 10/1935 | United Kingdom . | |
| 787717 | 12/1957 | United Kingdom . | |
| 1039598 | 8/1966 | United Kingdom . | |
| 1214926 | 12/1970 | United Kingdom . | |
| 1240756 | 7/1971 | United Kingdom . | |
| 1549270 | 7/1979 | United Kingdom . | |
| 2185533 | 7/1987 | United Kingdom . | |

*Primary Examiner*—Carlton R. Croyle
*Assistant Examiner*—Robert N. Blackmon
*Attorney, Agent, or Firm*—Harold L. Stowell et al.

[57] ABSTRACT

A jet pump is provided for pumping a secondary fluid through a duct by injecting a primary fluid into the duct in the form of sheet-like jets lying in a plane parallel to the direction of flow of secondary fluid through the duct.

8 Claims, 4 Drawing Sheets

BOUNDARY LAYER CONTROL IN SUPERSONIC NOZZLE

The present invention relates to jet pumps and in particular to jet pumps for use as eductors or thrust augmentors.

Jet pumps have been known and used for many years and operate utilizing the entraining properties of a high speed jet of primary fluid in order to pump a secondary fluid. A simplified example of a jet pump is shown in longitudinal section in FIG. 1, and comprises a primary nozzle 1 passing a jet of high-velocity primary fluid into a mixing duct 2 which is located coaxially with the nozzle 1. The mixing duct 2 has an inlet 3 through which the secondary fluid is induced to enter. The inlet 3 is usually aerodynamically faired to reduce any pressure loss which might be incurred by the entrained fluid as it enters the mixing duct 2. The mixing duct 2 is of constant cross-sectional area and of sufficient length to enable adequate mixing of the primary and second fluids such that the velocity distribution at the exit end of the duct 2 is substantially uniform. Typically the length of the mixing duct will be equal to at least six times its diameter when it is cylindrical. A diffuser 4 is located at the exit end of the mixing duct 2 so that at least part of the kinetic energy at the end of the mixing duct can be converted into an increase in static pressure before the fluid is finally delivered from the apparatus. As a result of this action the diffuser creates a region of low pressure at its inlet which, in turn, is propagated upstream to the inlet of the mixer duct and so assists in the entrainment of the secondary stream of fluid.

FIG. 2 shows a jet pump of another previously known type in which the primary fluid is ejected through an annular nozzle 1' peripherally along the mixing duct wall. This jet pump suffers from high skin friction losses between the high velocity primary jet and the wall and it is also long because there is only one surface of contact for mixing between the primary jet and the secondary stream.

One particular use of jet pumps is in augmenting the thrust of a jet engine for means of propulsion or for the attitude control of some vehicle such as an aircraft or ship. In the case of aircraft engines, a further benefit resulting from the entrainment of ambient air is a reduction in temperature and velocity thereby reducing levels of noise and other hazards to the environment. However, the length of the mixing duct required for mixing and diffusion of the mixed flow makes the jet pump heavy and so creates problems in accommodating the pump; furthermore the length of the duct gives rise to significant skin frictional losses between the fluid and jet pump walls which reduces the efficiency of the pumping action. An additional problem is that the primary nozzle and its attendant pipework forms an obstruction at the mouth of the inlet for the secondary air and this obstruction can limit the amount of secondary air which is entrained.

U.S. Pat. No. 3,525,474 describes a jet pump in which the mixing duct is of constant cross-section with a length less than the hydraulic diameter thereof. This improvement is achieved by employing a large number of small diameter primary injection nozzles located at and protruding into the aerodynamically faired inlet of the mixing chamber. The protruding nozzles have the disadvantage of reducing the aerodynamic suction created by the secondary entrained fluid as it passes over the faired inlet orifice surfaces. Moreover, the manufacture of such jet pumps is complicated by the need to provide a large number (in excess of 20 nozzles per square foot) of primary nozzles on the inlet lips each inclined to the direction of secondary fluid flow and having specially curved and faired outer surfaces for minimum interference with the flow.

Jet pumps are also known from EP-0,178,873; GB-2,185,533; GB-436,001; GB-787,719 and GB-1,214,926 in which a sheet of high velocity primary fluid is injected into a mixing duct through an annular nozzle lying perpendicular to the axis of the duct. The flow of primary flow over the wall of the mixing duct causes skin friction which reduces the velocity of the primary fluid stream. Furthermore, the annular jet forms a 'curtain' of primary fluid which tends to obstruct the flow of secondary fluid through the duct, thereby reducing the pumping effect of the primary fluid.

A jet pump is disclosed in GB-1,039,598 in which discrete jets of primary fluid are directed by nozzles into a mixing duct at an angle of 15° to 25° to the duct axis. The shapes of the nozzles are not disclosed but they are probably part-annular, the annulus surrounding the mixing duct and lying perpendicular to the duct axis. The 'curtain' of primary fluid injected into the mixing duct would cause considerable obstruction to the flow of secondary fluid through the duct, resulting in poor pumping efficiency.

A through-flow mixing apparatus is described in GB-1,240,756 in which two liquids are mixed in a pipe. One liquid is driven through the pipe by an external pump and a second liquid is injected by an external pump through closable cylindrical nozzles located 30° to 90° to the tube axis. However, the pumping efficiency of such an arrangement is poor (not surprisingly because the apparatus is not designed to be a jet pump).

A further disadvantage of the apparatuses described in GB-1,9039,598 and GB-1,240,756 is that the length of the nozzles (from the nozzle inlet to the nozzle outlet) must be large in order to set the required angle of the fluid jet. This, in turn, requires the nozzles to be bulky and heavy, which is very disadvantageous on aircraft.

It is an object of the invention to reduce the length of the mixing chamber required to accommodate the process of mixing which takes place between the primary and secondary flow through the pump by increasing mixing efficiency.

It is a further object of the present invention to provide a design of jet pump that can be made light-weight and compact.

The present invention overcomes the problem of the prior art devices by injecting sheet-like jets of primary fluid into the duct; such sheets, which lie in planes that are generally parallel with the duct axis, have a large surface area of contact with the secondary fluid and so entrainment of the secondary fluid is made more efficient. Also, the cross-sectional area of the sheets can be made very thin so that obstruction to the flow of secondary fluid through the duct caused by sheet jets of primary fluid is minimised.

Accordingly the present invention provides a jet pump comprising:

a duct extending along a duct axis and having an inlet and an outlet, the said outlet optionally being in the form of a flared diffuser, a plurality of nozzles for connection to a source of pressurised primary fluid, the nozzles being in the form of openings into the duct between the said inlet and the said outlet, the openings being elongate and having a major axis extending in the general direction of the duct axis to inject a sheet of primary fluid into the duct in a flow direction having a component along the duct axis and a component at right-angles thereto, in order to entrain a secondary fluid in the duct and to draw the secondary fluid into the said inlet and expel it out of the said outlet.

The elongate nozzle openings extend in the general direction of the duct axis but need not be precisely parallel with the axis; however, it is important that the sheets of fluid produced by the nozzles should present a narrow leading surface or edge to the secondary fluid passing through the duct so that the obstruction of the duct by the primary jets is minimised since such blockage limits the flow of secondary fluid through the duct.

It is a preferred feature of the present invention that the jet pump includes a passage extending in the general direction of the duct axis for conducting primary fluid to the nozzles, which are preferably simple slots in the wall of the duct. The passage should preferably have such a flow cross-section that the velocity of the primary fluid along the passage in the direction of the duct axis is maintained or increased in order that the direction of flow of the sheets of primary fluid has a component parallel to the duct axis; when the primary fluid is travelling at a sub-sonic velocity, the passage is of tapering flow cross-section which accelerates the primary fluid as it passes along the length of the passage. Downstream of the nozzles, the passage may have an outlet adjacent to the wall of the duct through which a small porportion of the primary fluid passes; this outlet prevents primary fluid that is travelling at supersonic speeds down the passage from reverting to subsonic speeds and to act as a boundary control layer, particularly in the diffuser region.

The mixing duct may include a parallel-sided mixing tube formed between said inlet and said diffuser. The said nozzle is preferably shaped so that the primary fluid does not adhere to the mixing duct wall, either immediately or after a short distance from its point of injection into the secondary fluid.

The primary nozzles may be dimensioned and shaped so that the injected primary fluid jets are made to penetrate, at least in part, to the wall forming the opposite face of the mixing duct and/or to the opposed diffuser wall where jets coalesce together to form an energetic boundary layer on the wall and thereby can be used to inhibit flow separation when a wide angled diffuser is located immediately downstream of the nozzles.

Numerous discrete thin sheets of primary fluid which have a very large surface area but a very small leading surface may be thus injected from a plurality of such primary nozzles in such a manner that they rapidly mix with the secondary fluid but do not significantly obstruct the flow of secondary fluid through the duct. It is preferred that the major dimension of each nozzle opening (i.e. its length) is at least 3 times its width and more preferably at least 5 times its width.

By using arrangements according to the invention the mixing duct length can be considerably shortened and in some cases a combined mixing and diffuser section can reduce the length of the jet pump length still further. The reduction in jet pump length has been found to reduce skin friction losses and so enables the pumping process to be more efficient than achieved hitherto.

BRIEF DESCRIPTION OF THE DRAWINGS

The specification is illustrated in the following drawings.

Throughout the following description similar elements in the drawings have been given identical reference numerals.

In the following description, we will refer to the pumping of secondary air by means of high velocity primary air but it will be appreciated that the invention is applicable to other fluids in either gaseous or liquid form.

Figure 3:
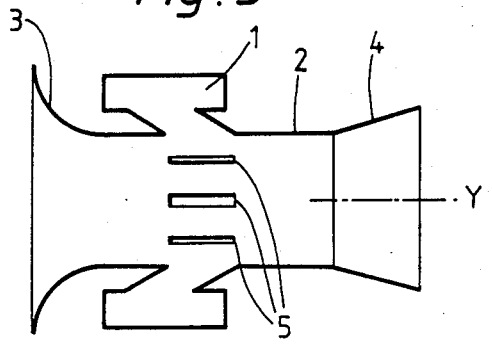
FIG. 3 is a longitudinal section through one form of jet pump according to the invention.

FIG. 3 shows a cylindrical duct having a mixing tube 2, a faired inlet 3 and a diffuser 4 in which discrete thin jets of primary air are injected through separate nozzles 5 which are formed as slots in the mixing duct wall 2. The nozzles connect a primary air passage 1 circumferentially disposed around the mixing duct 2 to the interior of the duct. The air passage 1 is angled with respect to the duct axis Y so that the direction of flow of the primary air in the jets has a component parallel and perpendicular to duct axis Y, i.e. parallel and perpendicular to secondary air flow from inlet 3 to diffuser 4, thus enhancing mixing and entrainment.

Figure 4:
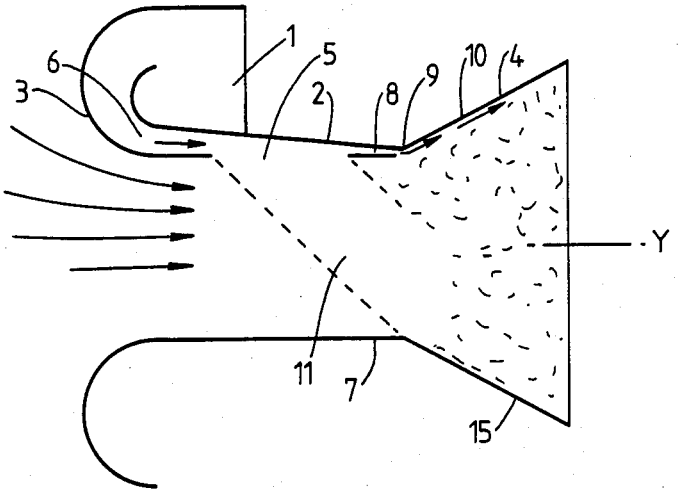
FIG. 4 is a longitudinal section through another form of jet pump according to the invention.
Figure 7A:
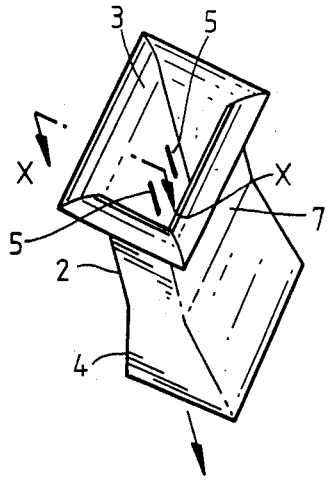
FIG. 7A is a three quarter perspective view of another form of jet pump similar to that of FIG. 4.
Figure 7B:
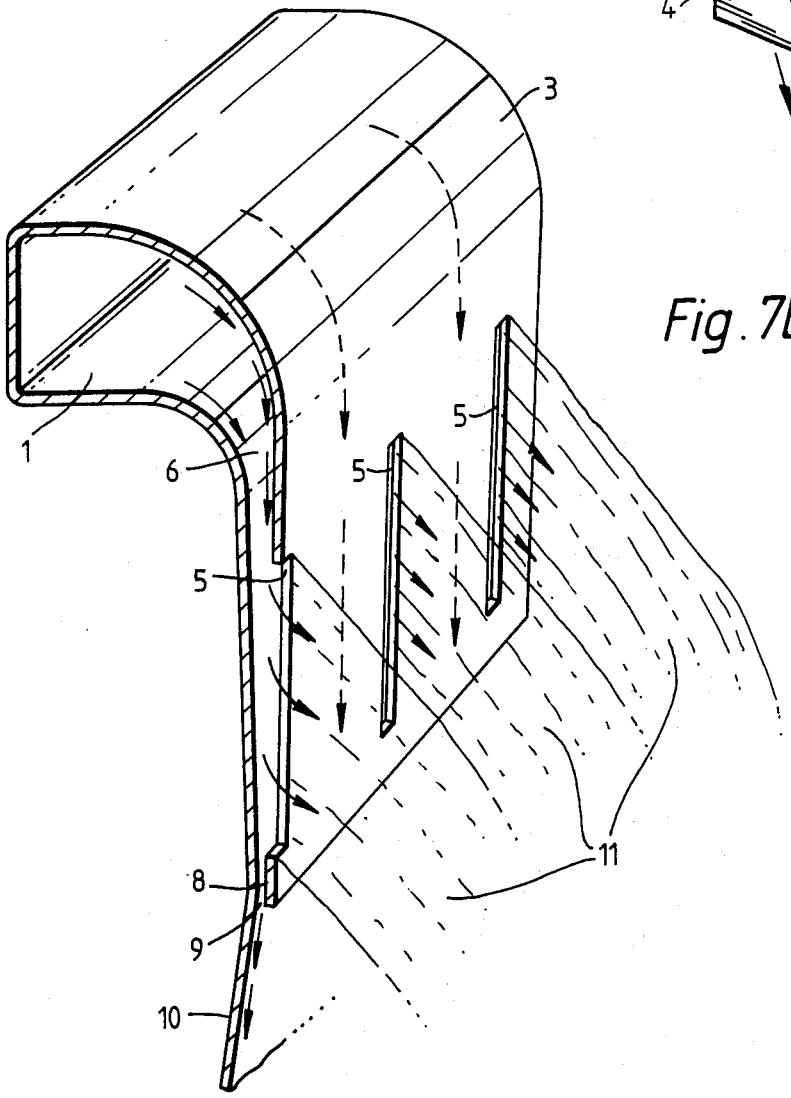
FIG. 7B is a perspective section on X—X of FIG. 7A.

FIGS. 4, 7A and 7B show a further embodiment of the present invention in which an accelerating passage 6 is used to produce the axial velocity component to the primary flow before it is released through slots 5 in the mixing duct wall. The resultant primary sheet-like jets are shown to partially penetrate to the opposite wall 7 of the mixing duct and to the opposed wall 15 of the diffuser where they energise the boundary layer on walls 7 and 15 and enable the flow to negotiate without detachment a diffuser 4 having a wide angle of divergence. A continuation 8 of the accelerating passage 6 is provided with a peripheral outlet or opening 9 which directs a stream of high energy air to energise the boundary layer at the end of the duct 2 and at the adjacent diffuser wall 10.

Figure 5:
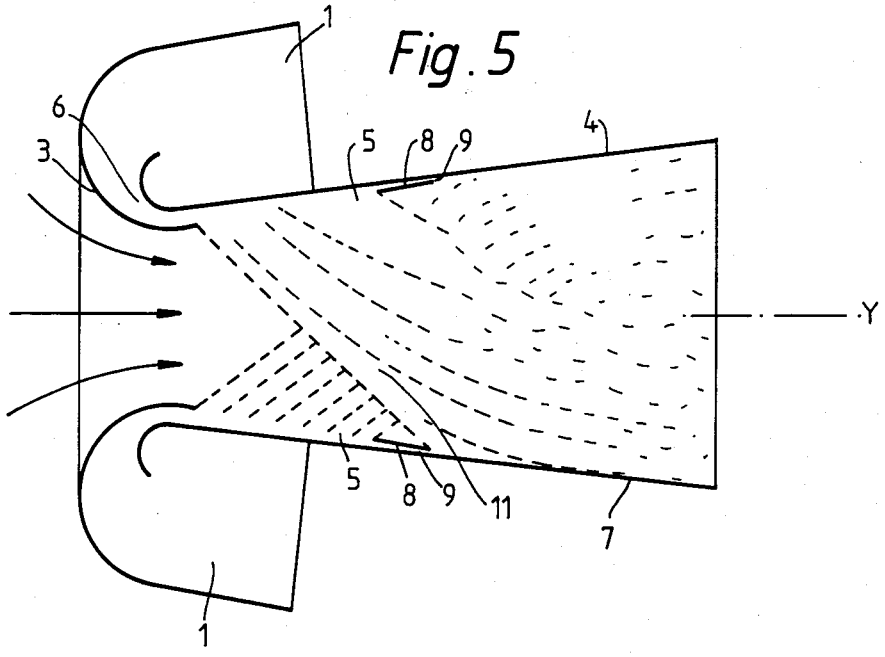
FIG. 5 is a longitudinal section through another form of jet pump according to the invention.

FIG. 5 shows a further embodiment of the present invention in which the mixing duct 2 no longer has a constant cross-sectional area but a combined duct/diffuser 4 is provided and the primary air injection is made through the wall of the duct/diffuser 4.

Figure 6:
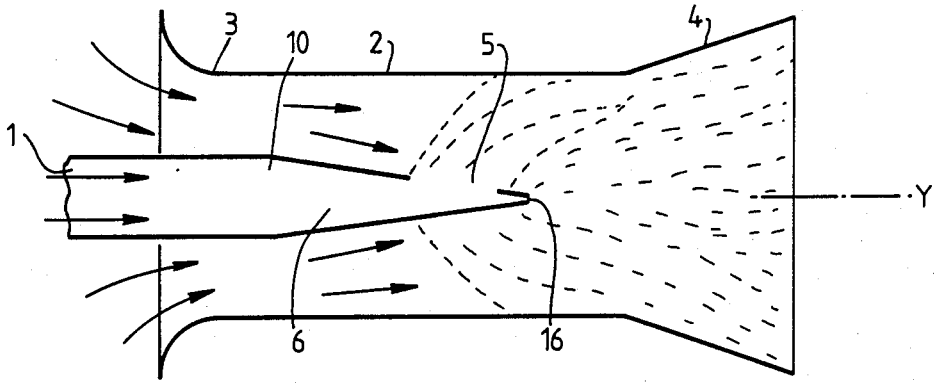
FIG. 6 is a longitudinal section through another form of jet pump according to the invention.

FIG. 6 shows a further embodiment of the present invention in which the mixing duct 2 is provided with an axially located primary air passage 10 for the injection of the primary air. Longitudinal slots 5 are formed through the wall of passage 10 of the mixing duct 2 and the passage 10 tapers to provide the accelerating passage 6, the end of which has an opening 16 through which a minor proportion of the primary air passes. The slotted end of the passage 10 may be rotatable by means not shown to increase mixing and entrainment effects.

Figure 1:
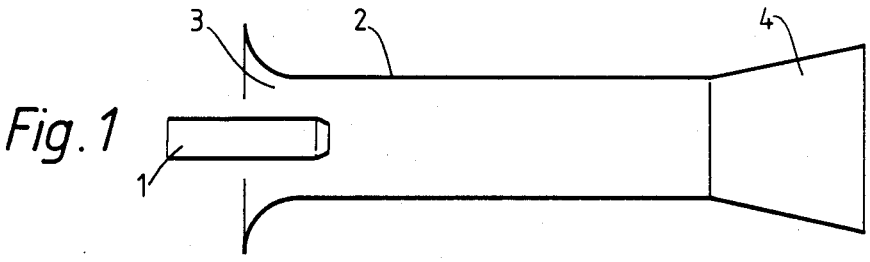
FIG. 1 is a simplified example of a jet pump shown in longitudinal section.
Figure 2:
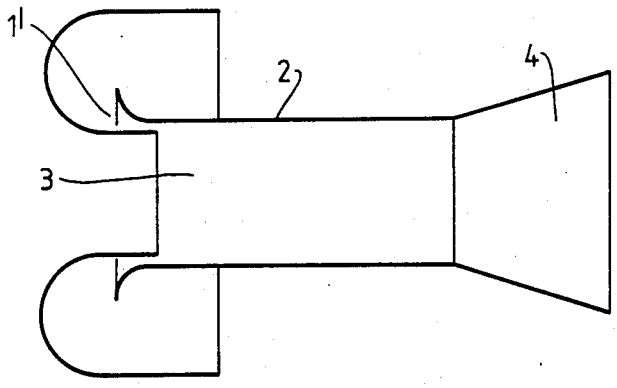
FIG. 2 shows a jet pump of another previously known type in which the primary fluid is injected through an annular nozzle, peripherally along the duck wall.
Figure 8:
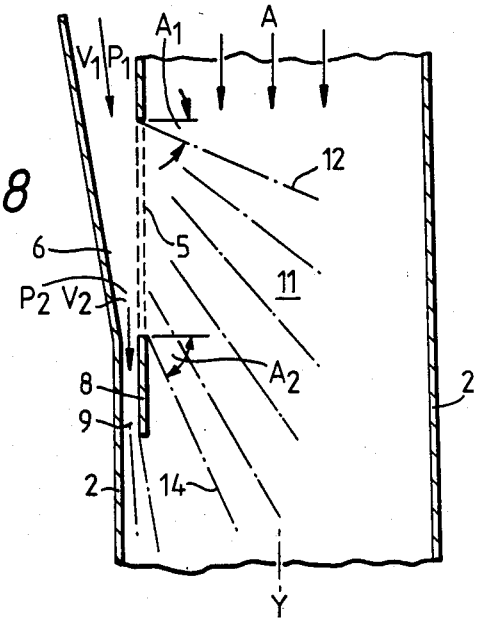
FIG. 8 is a sectional view of part of a further jet pump of the present invention.

FIG. 8 shows a pump in which a sheet jet 11 produced by primary air passing through slot 5 has a leading edge 12 and a trailing edge 14 at angles $A_1$ and $A_2$ (respectively) to perpendicular to the wall 2. There is a tendency for the flow of secondary air (shown by arrows A) to push the leading edge 12 and the adjacent parts of the sheet jet 11 towards the trailing edge causing a thickening of the trailing edge (as viewed in the direction of arrows A) which obstructs the flow of secondary air through the duct 2. This problem can be overcome by causing the sheet jet to flare out as shown in FIG. 8, i.e. by making the angle $A_2$ greater than angle $A_1$. Such a state of affairs is brought about by the configuration of the accelerating passage 6 which causes the velocity (in the direction of axis Y) of the the primary air $v_2$ at the end of the slot 5 to be greater than that $v_1$ at the beginning of the slot and thus the pressure $p_2$ at the end of the slot is less than that $p_1$ at the beginning of the slot, which causes angle $A_2$ to be greater than angle $A_1$. Preferably angle $A_1$ is not less than 10° and angle $A_2$ is at least 70°.

The accelerating passageway 6 has a wall 8 that continues past the slot 5 to provide a peripheral opening 9; this opening receives only a small portion of the primary air passing through the passage 6 (for example about 5% of the air) and the vast majority of the air is ejected through the slots 5. The air passing through the peripheral opening 9 performs two functions:

(i) it allows the air passing through the very end of the slot 5 to have a component of motion in the axial direction of the duct 2, i.e. angle $A_2$ is greater than zero. This can be appreciated if one considers what would happen if opening 9 were blocked off—there would then be a stationary body of air at the end of the accelerating channel 6 that would force primary air that has passed down the accelerating passageway 6 perpendicularly towards the centre of the duct. As stated above it is preferred to make an angle $A_2$ at least 70° and (ii) it provides a flow of air along the cylindrical wall 2 which energises the boundary layer adjacent to the wall and prevents the flow from becoming detached at the diffuser 4; the distance between the opening 9 and the diffuser can be varied to provide optimum pumping. It will be appreciated that skin friction will arise between the peripheral jet and the wall 2 but since the peripheral jet constitutes only a small part of the total primary air, the resulting energy loss can be tolerated.

In the above figures it would be possible to use orifices through the mixer wall of a shape other than the longitudinal slots shown.

The use of nozzles in the form of simple slots in the wall of the duct rather than a complex nozzle arrangement has not only the advantage of simplicity and low manufacturing cost but also reduces the weight of the pump.

I claim:

1. A jet pump comprising:

a duct extending along a duct axis and having an inlet and an outlet, the duct including a duct wall, a passage for connection to a source of primary fluid and extending in the general direction of the duct axis, the passageway tapering in the direction of flow of primary fluid therein, a wall separating the passage from the duct, a plurality of nozzles in the form of elongate slots formed in the said separating wall and extending in the general direction of the duct axis for injecting sheets of primary fluid into the duct in a flow direction having a component along the duct axis and a component at right angles thereto in order to entrain secondary fluid in the duct and draw secondary fluid into the said duct inlet and expel it out of the duct outlet, and a peripheral opening at the end of the passage for directing primary fluid into the duct over a part of the duct wall adjacent to the opening.

2. A jet pump as claimed in claim 1, wherein the passage extends through the duct inlet along the axis of the duct and the nozzles are slots in the wall of the passage.

3. A jet pump as claimed in claim 1, wherein the duct outlet is in the form of a flared diffuser.

4. A jet pump as claimed in claim 3, wherein the nozzles are so arranged that part of the said sheets of primary fluid are directed into the said diffuser.

5. A jet pump as claimed in claim 1, wherein the said slots extend parallel to the duct axis.

6. A jet pump as claimed in claim 1, wherein the said elongate slots each have a length at least three times greater than its width.

7. A jet pump as claimed in claim 1, wherein the said elongate slots each have a length at least five times greater than its width.

8. A method of pumping a secondary gas through a duct having an inlet and an outlet by injecting primary gas into the duct to entrain the secondary gas and draw the secondary gas in through the inlet and expel it from the outlet, the method comprising injecting primary gas into the duct by passing it at supersonic speeds along a tapering passage that is divided from the duct by a wall having a plurality of elongate slots formed therein that extend in general direction of secondary gas flow, thereby forming a plurality of thin sheet-like jets of primary gas extending into the duct, wherein the direction of flow of primary gas within the said jets has a component in the said general direction of secondary gas flow through the duct and a component at right-angles thereto, and wherein the method further comprises injecting into the duct a minor proportion of primary gas through a peripheral opening at the end of the passage, the said minor proportion of primary gas passing over a part of the duct wall adjacent to the opening to energize the boundary layer of gas on the duct wall.

* * * * *